US005104487A

United States Patent [19]

Taggart et al.

[11] Patent Number: 5,104,487

[45] Date of Patent: Apr. 14, 1992

[54] PAPERMAKING USING CATIONIC STARCH AND NATURALLY ANIONIC POLYSACCHRIDE GUMS

[75] Inventors: Thomas E. Taggart; Michael A. Schuster; Alan J. Schellhamer, all of Jacksonville, Fla.

[73] Assignee: Betz Paper Chem., Inc., Jacksonville, Fla.

[21] Appl. No.: 568,396

[22] Filed: Aug. 16, 1990

Related U.S. Application Data

[63] Continuation-in-part of Ser. No. 327,847, Mar. 23, 1989, which is a continuation-in-part of Ser. No. 240,774, Sep. 2, 1988.

[51] Int. Cl.[5] ..... D21H 17/41

[52] U.S. Cl. ..... 162/168.3; 162/175; 162/178; 162/183

[58] Field of Search ..... 162/175, 178, 183, 168.3, 162/168.2, 168.1, 164.6

[56] References Cited

U.S. PATENT DOCUMENTS 3,384,536 5/1968 Sandberg et al. ..... 162/178

FOREIGN PATENT DOCUMENTS 8205592-2 9/1982 Sweden .

*Primary Examiner*—Peter Chin

*Attorney, Agent, or Firm*—Alexander D. Ricci; Richard A. Paikoff

[57] ABSTRACT

The present invention is directed to a paper having improved properties, a process of producing the paper, and compositions used in the process of producing the paper. The invention generally comprises using a cationic starch in combination with a naturally anionic polysaccharide gum.

33 Claims, 2 Drawing Sheets

BLANK

STARCH DOSAGE = 30 lb/T

BLANK

STARCH DOSAGE = 50 lb/T

NEW METHOD

STARCH DOSAGE = 30 lb/T
XANTHAN GUM DOSAGE = 9 lb/T

NEW METHOD

STARCH DOSAGE = 50 lb/T
XANTHAN GUM DOSAGE = 15 lb/T

GUNNARSON et al METHOD

STARCH/XANTHAN DOSAGE (COMBINED ADDITION)= 30 lb/T / .225 lb/T

GUNNARSON et al METHOD

STARCH/XANTHAN DOSAGE (COMBINED ADDITION)= 50 lb/T / .375 lb/T

BLANK

STARCH DOSAGE = 30 lb/T

BLANK

STARCH DOSAGE = 50 lb/T

NEW METHOD

STARCH DOSAGE = 30 lb/T
XANTHAN GUM DOSAGE = 9 lb/T

NEW METHOD

STARCH DOSAGE = 50 lb/T
XANTHAN GUM DOSAGE = 15 lb/T

GUNNARSON et al METHOD

STARCH/XANTHAN DOSAGE (COMBINED ADDITION)= 30 lb/T / .225 lb/T

GUNNARSON et al METHOD

STARCH/XANTHAN DOSAGE (COMBINED ADDITION)= 50 lb/T / .375 lb/T

PAPERMAKING USING CATIONIC STARCH AND NATURALLY ANIONIC POLYSACCHRIDE GUMS

This application is a continuation-in-part of Ser. No. 07/327,847 filed Mar. 23, 1989, which is a continuation-in-part of Ser. No. 07/240,774 filed Sept. 2, 1988.

BACKGROUND OF THE INVENTION

Paper or paperboard normally is made by producing a stock slurry or furnish, comprised mainly of cellulosic wood fibers but also often containing inorganic mineral fillers or pigments, depositing the slurry on a moving papermaking wire or fabric, and forming a sheet from the solid components by draining the water. This process is followed by pressing and drying operations. Many different organic and inorganic chemicals are often added to the furnish before the sheet forming process in order to make processing less costly or more rapid, or to attain special functional properties in the final paper or paperboard product.

The paper industry continuously strives for improvements in paper quality as well as reductions in manufacturing costs. Sheet strength is often a key factor in achieving or balancing these goals. Increases in the strength potential of the fiber furnish, for example, enable the papermaker to improve sheet opacity and printability or reduce fiber furnish raw material cost through substitution of expensive fiber with elevated loadings of low cost filler. A stronger sheet also provides the opportunity for cost savings through a reduction in pulp refining energy.

Starches are used by the paper industry to increase the inter-fiber bond strength of paper or paperboard as typically characterized by standardized Tensile, Mullen Burst, or Scott Bond tests. Papermaking starches function to enhance the fiber furnish strength potential by creating additional hydrogen bonding sites between contiguous fiber surfaces when the sheet is formed and dried. Higher starch addition rates are often desired to achieve increases in bonding strength. However, starch adsorption on the fiber is generally incomplete, resulting in reduced starch efficiency, operating difficulties attributable to high levels of unadsorbed starch recirculating in the process filtrate circuit, and the resulting inability to further increase the starch addition level. These effects are evident even for the cationically derivatized starch products, which are utilized in an attempt to obtain greater adsorption.

BRIEF DESCRIPTION OF THE DRAWINGS

In FIGS. 1A-1F the furnish contains 10% (wt. %) filler, and in FIGS. 2A-2F the furnish contains 30% (wt. %) filler. These photographs provide important insight into distribution of filler in the handsheets.

GENERAL DESCRIPTION OF THE INVENTION

Figure 1A:
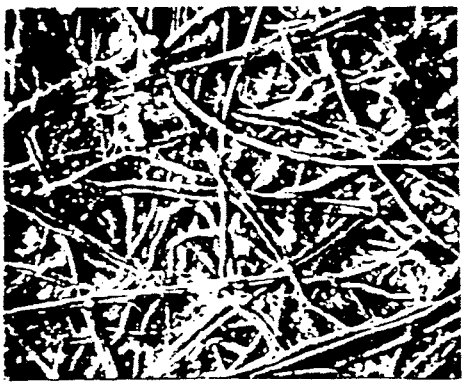
FIGS. 1A-1F and 2A-2F are scanning electron microscope (SEM) photographs of several handsheets. The SEM photographs are Robinson backscatter images at 90× magnification.

The present invention is directed to a process for making paper or paperboard, a paper or paperboard made by the process and a composition or mixture used in the process and which becomes an integral part of the produced paper.

The process entails the normal steps of providing a paper furnish comprised of cellulosic fibers with or without additional mineral fillers suspended in water, depositing the furnish on a paper making wire, and forming a sheet out of the solid components of the furnish while carried on the wire.

The present invention relates to a process for making paper or paperboard comprising the addition of any cationically substituted starch to the pulp fiber components of a papermaking furnish along with the addition of an effective proportional amount of a naturally anionic polysaccharide gum such as xanthum gum. The gum should contain natural acid functional groups and have moderate to high molecular weight. The process of this invention provides improved paper strength properties by increasing the extent of precipitation and retention of cationic starch on papermaking furnish fibers, thereby increasing the strength benefit from its use at a given level of addition and, particularly, at higher desired levels of cationic starch addition.

Alternatively, the process of this invention may provide the papermaker with the ability to increase sheet filler loading for increased opacity or reduced fiber raw material cost while maintaining necessary sheet strength specifications which normally decrease with increased sheet filler content. The process of this invention also reduces the build-up of unretained cationic starch in the recirculating process filtrate circuit, thereby reducing production losses associated with excessive foaming and chemical slime deposition in the process. The process of this invention will also serve to reduce the Biological Oxygen Demand (BOD) loading contributed by unretained cationic starch in the process effluent.

Paper or paperboard normally is made by producing a stock slurry or furnish, comprised mainly of cellulosic wood fibers but also often containing inorganic mineral fillers or pigments, depositing the slurry on a moving papermaking wire or fabric, and forming a sheet from the solid components by draining the water. This process is followed by pressing and drying operations. Many different organic and inorganic chemicals are often added to the furnish before the sheet forming process in order to make processing less costly or more rapid, or to attain special functional properties in the final paper or paperboard product.

SPECIFIC EMBODIMENTS OF THE INVENTION

The inventors have discovered that dilute solutions of natural xanthan gum or other unmodified anionic polysaccharide gums including gum arabic, gum ghatti, pectin, tragacanth, karaya, and algin added to a papermaking furnish in a particular weight ratio to the addition of cationic starch, effectively increases the adsorption and retention of cationic starch, resulting in proportionately increased sheet strength for a given level of cationic starch addition. The inventors have also discovered that in order to minimize macro-coagulation of the cationic starch/anionic gum complex and achieve uniform distribution of the starch and maximum strength gain, it is critical that the anionic gum be added separately and following the addition of cationic starch. Furthermore, the inventors have discovered that the process of the present invention is wholly compatible with, and further enhanced by, the subsequent use of typical papermaking fine solids retention aids such as medium and high molecular weight cationic and anionic polyacrylamide copolymers.

Cationically derivatized starches useful in the process of the present invention are most commonly produced from corn or potatoes, but may also be produced from tapioca, rice, and wheat. Their cationic character in aqueous solution is produced by the presence of either tertiary or quaternary amine groups which are substituted on the starch molecules during their manufacture. The cationicity of these starches is defined by the Degree of Substitution (DS) or average number of amine groups substituted for hydroxyl groups per anhydroglucose unit of starch, and may range from about DS=0.01 to DS=0.10.

The cationic starch preferably is first hydrated and dispersed in water before addition to the papermaking furnish. Either starches that have to be gelatinized or "cooked" at the use location or pre-gelatinized, cold water dispersible starches can be used. Preferably the starch dispersion will contain about 0.1% to 10% of cationic starch, based on the weight of the solution or dispersion.

The cationic starch may be added to the total furnish or it may preferably be added to the fiber furnish prior to blending in any inorganic fillers. The latter preferred method is intended to promote maximum starch adsorption on furnish fibers versus fillers, thereby promoting maximum inter-fiber bonding strength development and also minimizing the negative effect on sheet opacity by minimizing starch-induced filler coagulation.

The cellulosic fibers used in accordance with the invention, and those normally used in paper making are virgin chemical pulp, and combinations thereof with mechanical pulp, recycled secondary fiber pulp and mixtures of such with the other fiber sources are exemplary.

Xanthan, which is the preferred gum of the invention, is a naturally occurring anionic gum produced by the microorganism Zanthomonas campestris. This microbial gum was originally isolated from the rutabaga plant. Large-scale industrial fermentation is now used to produce a polysaccharide material identical to that formed on living cabbage tissues under natural conditions.

Xanthan gum consists of mannose, glucose and glucuronic acid. The backbone is built up of beta-D-glucose units linked through the 1 and 4 positions. Side chains contain two mannose units and a glucuronic acid unit and are linked to every other glucose residue on the main chain. Also, about one-half of the terminal D-mannose units contain a pyruvic acid residue. The pyruvic and glucuronic acid groups in the side chains are responsible for the anionic nature of xanthan gum. Reported molecular weights for the xanthan gum are on the order of 2 million with 100,000 to 3,000,000 being the average molecular weights for the polysaccharide gums in general.

Aside from xanthan gum, similar polysaccharide-type gums exist which contain the described acid functional groups. The following natural gums possess the properties which enable them to be substituted for the xanthan gum in the process of the present invention: gum arabic, karaya, gum ghatti, pectin, tragacanth, or algin.

In the process of the present invention, the anionic gum should be added to the pulp furnish following the addition of cationic starch with some mixing after each addition. The anionic gum is added in the form of an aqueous solution containing from about 0.1% to 5.0% gum. The amount of anionic gum added to the furnish preferably is about 5% to 60%, most preferably about 10% to 40%, based on the weight of cationic starch addition.

Papermaking retention aids are used to increase the retention of fine furnish solids in the web during the turbulent process of draining and forming the paper web. Without adequate retention of the fine solids, they are either lost to the process effluent or accumulate to excessively high concentrations in the recirculating white water loop and cause production difficulties including deposit build-up and impaired paper machine drainage.

Additionally, insufficient retention of the fine solids and the disproportionate quantity of chemical additives which are adsorbed on their surfaces reduces the papermaker's ability to achieve necessary paper quality specifications such as opacity, strength, and sizing.

The extent to which typical papermaking retention aids can function to increase the incorporation of papermaking functional chemical additives into the paper sheet, thereby increasing the benefit and efficiency of their use, depends entirely upon the degree of adsorption or precipitation of the functional additives on the surfaces of the furnish solids. Therefore, the process of the present invention promotes the benefit of papermaking retention aids by promoting more complete adsorption and retention of cationic starch on the furnish solids.

Any known papermaking retention aid may be used in addition to the process of the present invention. Those most commonly employed are cationic or anionic polyacrylamide copolymers with Molecular Weights ranging from about 1 million to 18 million and charge densities ranging from about 1% to 40%, expressed as the mole % of charged moiety. They are normally applied as highly dilute aqueous solutions to the diluted papermaking furnish immediately prior to the paper machine headbox.

In Swedish Patent Application No. 8205592-2 by Gunnarsson et al., cationic starch and xanthan gum are both added to a paper furnish to improve retention and binding of fillers. The patent calls for the preparation of a separate filler furnish by dispersing the starch and xanthan together in water before cooking, adding the resultant mixture to an aqueous slurry of mineral fillers, and then incorporating an additional anionic or cationic colloidal inorganic polymer to the filler slurry. The filler furnish, described as a complex gel structure, is then mixed into the slurry of cellulosic fibers.

The present invention provides a substantially different and improved method of preparing such filler-containing paper furnishes although the present invention is just as useful in non-filler-containing furnishes. The present invention provides better distribution of both the starch and filler and, as a result, higher opacity values and more uniform sheet formation. These improvements result from the aforementioned novel and critical addition points and order of addition of the cationic starch and xanthan gum compared to the method of Gunnarsson e al.

The process of the present invention will be better understood by considering the following examples. Unless otherwise noted, all parts and percentages reported therein are parts and percentages by weight.

EXAMPLE 1

Example 1 illustrates the incomplete adsorption of cationic starch on wood pulp fiber as the starch addition level is increased. The data presented in Table 1 were obtained through a laboratory starch adsorption procedure involving the use of a colorimeter. The test is based on the characteristic blue color formed when the amylose fraction of the starch molecule is complexed with a $KI/I_2$ solution. The procedure involves the use of a dynamic retention test device (Britt Dynamic Retention jar) and applied vacuum to roughly simulate the forming table on a paper machine. A 200 mesh (125-P) screen is utilized in the Britt jar. Filtrate samples from mixing and draining furnish in the Britt jar are obtained as the test samples in this procedure. A colorimeter is then utilized to measure the filtrate for starch content after the filtrate is mixed and treated with a given volume of the starch reagent ($KI/I_2$). In order to accurately determine starch mass per filtrate volume, a calibration curve must first be generated via the colorimeter with known quantities of the particular starch to be utilized in the testing.

TABLE 1

Starch Adsorption on Fiber at Various Addition Levels

| STARCH[1] ADDED (lb/T) | STARCH IN FILTRATE (lb/T) | STARCH ON FIBER (lb/T) | STARCH ADSORPTION (%) |
|---|---|---|---|
| 10 | 4.0 | 6.0 | 60.0 |
| 20 | 9.5 | 10.5 | 52.5 |
| 30 | 16.8 | 13.2 | 44.0 |
| 40 | 24.2 | 15.8 | 39.6 |
| 50 | 32.5 | 17.5 | 35.1 |
| 60 | 39.7 | 20.3 | 33.8 |
| 70 | 48.2 | 21.8 | 31.2 |
| 80 | 55.1 | 24.9 | 31.1 |
| 90 | 62.7 | 27.3 | 30.3 |
| 100 | 68.0 | 32.0 | 32.0 |

[1]Staley Stalok 600

The initial testing medium added to the Britt jar consists of a 0.5% consistency bleached Kraft hardwood/softwood (50/50) fiber furnish refined to 350–400 ml Canadian Standard Freeness (CSF) and containing 0.75% papermaker's alum (pH 4.5). A fiber-only test furnish was selected for this test to eliminate the adverse effects of light-scattering pigments on the colorimeter and also to allow direct measurement of starch adsorption effects on the fiber fraction. This same test furnish was used in Example 1 to which increasing levels of Stalok 600 (Staley) potato starch were added. Stalok 600 is a cationic pre-gelatinized, cold water dispersible starch with a 0.032 degree of substitution (DS). This starch is a quaternary amine-substituted potato starch with a nitrogen content of 0.30 weight percent.

The data in Table 1 clearly demonstrate the incomplete adsorption of cationic starch. For example, at a 10 lb/T starch addition level, only 60% of the starch was retained on the fiber.

EXAMPLE 2A

In Table 2A, the positive effect of natural xanthan gum on starch adsorption is demonstrated through direct addition of the gum to the starch prior to addition to the test furnish. The dry starch and xanthan gum were prepared separately in dilute solution form before the gum was combined with the starch. The same test procedure, test furnish, and starch type described in Example 1 were utilized in this study. The xanthan gum used was Kelco Kelza S.

The data show that starch adsorption in the test furnish is significantly increased over the starch-only case as the xanthan gum dosage level is increased. The anionic xanthan gum effectively destabilizes the cationic starch in solution and provides a condition more favorable to the adsorption or retention of starch on fiber. The optimum addition rate for xanthan gum in this study was approximately equivalent to 30–40% of the starch addition or 9–12 lb/T. The combined xanthan gum and starch solution formed large starch-gum flocs which held together even through intense agitation. This result is critical to the resultant sheet properties as demonstrated in Example 2B.

TABLE 2A

Xanthan Gum Effect on Starch Adsorption (Combined Starch-Gum Addition*)

| STARCH[1] ADDED (lb/T) | XANTHAN GUM[2] ADDED (lb/T) | STARCH ADSORPTION (%) |
|---|---|---|
| 30 | 0 | 50.1 |
| 30 | 3 | 75.2 |
| 30 | 6 | 82.6 |
| 30 | 9 | 89.0 |
| 30 | 12 | 84.2 |
| 30 | 15 | 80.8 |

[1]Staley Stalok 600
[2]Kelco Kelzan S
*Starch and Xanthan gum were prepared as individual solutions, combined, and added to the furnish as one solution.

EXAMPLE 2B

A handsheet study was conducted to evaluate the effects of the cationic starch and xanthan gum additives on sheet properties. A complete paper furnish was made comprising 73.75% bleached Kraft fiber (50% hardwood/50% softwood blend), 20% kaolin clay (Huber Hi-White), 5% titanium dioxide (SCM Glidden Zopaque RG), 0.75% papermaker's alum, and 0.50% rosin size (Hercules dry Pexol 200). The final furnish pH was 4.5. The pulp was first refined to 353 ml CSF. The same starch and xanthan types used in Example 2A were utilized in this study, the results of which are summarized in Tables 2B and 2B-1.

Five handsheets were made at each condition listed in Table 2B. Handsheets were prepared from the resulting furnish using a Noble and Wood sheet forming apparatus. The pressing (20 psi) and drying (240° F.) steps were conducted with the same apparatus. After drying, the sheets were conditioned for 24 hours at approximately 50% relative humidity and 73° F. The sheets were then cut to a 7"×7" area, weighed, and evaluated individually for opacity, Mullen burst, and tensile strength. An additional test was conducted to qualitatively determine starch distribution in the handsheets by applying the same $KI/I_2$ starch reagent to the surface of each sheet. Since the reagent stains starch-containing areas deep blue, a mottled or grainy sheet appearance indicates an uneven distribution of starch. The final sheet measurement was obtained when the remaining portion of each sheet was oven-dried, weighed, and ashed in a muffle furnish (930° C) to determine ash content (weight percent).

TABLE 2B

| Condition | Avg. Sheet Wt./Area ($g/m^2$) | Avg. Ash Content (%) | Avg. Opacity | Avg. Mullen Burst ($g/cm^2$) | Avg. Tensil Strength (g/cm) | Starch Distribution |
|---|---|---|---|---|---|---|
| | HANDSHEET TEST RESULTS | | | | | |
| No Starch | 42.38 | 8.43 | 72.5 | 288.3 | 1101.8 | — |
| Starch-Only(1) (30 lb/T) | 50.93 | 19.03 | 82.2 | 406.3 | 1460.8 | Even Color |
| Separate Addition Starch/Xanthan(2) (30 lb/T/3 lb/T) | 51.56 | 19.36 | 82.0 | 550.5 | 1584 | Even Color |
| Combined Addition* (Large Spots) Starch/Xanthan (30 lb/T/3 lb/T) | 51.24 | 19.01 | 82.5 | 408.5 | 1409.0 | Mottled |
| Combined Addition** Starch/Xanthan (30 lb/T/3 lb/T) | 50.93 | 18.79 | 82.4 | 435.9 | 1341.1 | Mottled (Large Spots) |

(1)Staley Stalok 600
(2)Kelco Kelzan S
*Starch and xanthan Gum prepared as individual solutions, combined, and added as one solution.
**Starch and Xanthan Gum mixed in powder form, and prepared and added as one solution.

TABLE 2B-1

| Condition | Standardized Mullen ($g/cm^2$) ($g/m^2$) | % Change vs. Starch-Only | Standardized Tensile (g/cm) ($g/m^2$) | % Change vs. Starch-Only |
|---|---|---|---|---|
| | Standardized Mullen/Tensile Data From Table 2B | | | |
| Starch-Only (30 lb/T) | 8.0 | — | 28.7 | — |
| Separate Addition Starch/Xanthan (30 lb/T/3 lb/T) | 10.9 | +36% | 31.3 | +9% |
| Combined Addition Starch/Xanthan (30 lb/T/3 lb/T) | 8.0 | 0% | 27.5 | −4% |
| Combined Addition Starch/Xanthan (30 lb/T/3 lb/T) | 8.5 | +6% | 26.0 | −9% |

The data of Table 2B are averages of replicated tests for all sheets per experimental condition. The tensile strength and Mullen Burst data are then standardized in Table 2B-1 to correct for differences in sheet weight and ash content. The standardization procedure involves the division of the average burst or tensile value by the corresponding average grammage value. This value is then multiplied by the corresponding ratio of treated handsheet % ash/starch-only % ash so that each condition is standardized to a constant ash value. Table 2B-1 demonstrates significant mullen and tensile increases for the separate addition case of 30 lb/T starch followed by 3 lb/T xanthan gum. However, the combined addition of the same dosage levels of starch and xanthan did not increase the sheet strength. Combined addition involved the pre-mixing of starch-xanthan gum either in powder form or from separate solutions to create a single solution.

Based on these results, it is evident that the situation which enabled the high starch adsorption values in Example 2A, pre-mixed cationic starch and xanthan gum, did not provide strength increases. This result is explained through the qualitative observations of starch distribution summarized in Table 2B. The starch distribution test shows that either method of combined addition results in an uneven starch distribution in the sheet. This effect is a result of both the strong affinity of cationic starch and xanthan gum for each other and the moderate to high molecular weight of the xanthan gum, resulting in tenacious agglomerates when these additives are combined in solution prior to furnish addition. When the complexation reaction between additives takes place within the furnish (separate addition) after the starch has already begun to adsorb, the starch is more evenly distributed, as demonstrated by the even appearance of color in the distribution test. For starch to be effective at promoting or reinforcing fiber-fiber bonds, it is well known that it must be evenly distributed (separate addition) and not retained in localized areas in the sheet (combined addition).

EXAMPLE 3

A brief starch adsorption study conducted using the same test procedure and fiber-only test furnish described in Example 1 demonstrated the efficacy of another naturally anionic gum, gum arabic. As summarized in Table 3, anionic gum arabic exhibited a positive effect on starch adsorption when added separately after the Stalok 600 starch. Gum arabic is a dried exudate from various species of the acacia tree. Like xanthan, gum arabic contains glucuronic acid groups in the side chains. The reported molecular weight range from 260,000–1,160,000.

TABLE 3

| Starch Added(1) (lb/T) | Gum Arabic Added(2) (lb/T) | % Starch Adsorption |
|---|---|---|
| | Effect of Gum Arabic on Starch Adsorption | |
| 30 | 0 | 56.8 |
| 30 | 9 | 74.8 |
| 30 | 12 | 76.5 |

(1)Staley Stalok 600
(2)Colloids Naturels Technogum IRX-602000 (Acacia)

EXAMPLE 4

Table 4 summarizes a study conducted in the filler-containing furnish described in Example 2B to determine the effect of the starch and xanthan gum on fines retention both with and without the cationic polymer (Betz® Polymer CDP-713). Each test involved the addition of 500 ml of 0.5% consistency furnish to the Britt jar. The furnish was then agitated at high shear (1400 rpm) and dosed with appropriate aliquots of the additives (separate addition) prior to the filtering step. Fines retention was calculated by comparing the mass of fine solids per unit volume in the filtrate to the mass of fine solids per equivalent unit volume present in the original furnish.

TABLE 4

| Effect of Additives on Fines Retention | | | |
|---|---|---|---|
| Starch[1] Added (lb/T) | Xanthan Gum[2] Added (lb/T) | Cationic Polymer[3] Added (lb/T) | % Fines Retention |
| 0 | 0 | 0 | 17.6 |
| 0 | 0 | 1.25 | 42.7 |
| 0 | 3 | 0 | 19.8 |
| 30 | 0 | 0 | 33.7 |
| 30 | 3 | 0 | 43.8 |
| 30 | 3 | 1.25 | 71.7 |

[1]Staley Stalok 600
[2]Kelco Kelzan S
[3]Betz Polymer CDP-713 (a cationic acrylamide polymer with a MW greater than 5 million)

The data in Table 4 show that the addition of xanthan gum provides improvements in fines retention over starch-only, polymer-only, and starch-polymer conditions. Retention improvements via xanthan gum are a result of improved starch adsorption which provides the necessary increase in cationic attachment sites for the predominantly anionic filler and fiber fines. Stalok 600 cationic starch and Kelco Kelzan S were utilized in this study.

EXAMPLE 5

A handsheet study was conducted to compare the aforementioned prior art to this novel method of application of starch and xanthan gum. As previously described, Swedish Patent Application 8205592-2 by Gunnarsson and Inger involves the use of cationic starch and xanthan gum in paper furnishes to increase the retention and binding of fillers and/or fibers The patent calls for the step-wise formation of a complex gel structure involving an aqueous slurry of mineral fillers to be utilized in the furnish. In short, a reaction product is first formed when a dry mixture of 0.25–5.00 parts xanthan gum to 100 parts cationic starch is dispersed in water. This compound is then reorganized to a secondary structure upon direct addition to the filler slurry. The cationic starch and xanthan mixture is generally added at 2–20% of the dry filler weight. Finally, a third structure is formed when aluminum sulfate or a specific colloidal inorganic polymer is added to the filler slurry. The final reaction product is then added to a separate slurry of cellulosic fiber.

In Example 5, the Gunnarsson et al. method was closely simulated in the laboratory preparation of handsheets. The Gunnarsson method was compared to the present invention involving the separate additions of cationic starch and xanthan gum, in sequence, to the fiber. The treated fiber was subsequently blended with the filler and alum prior to the formation of individual handsheets. A basic outline of both the Gunnarsson and present invention methods of furnish preparation is described in Table 5A. A more detailed description of each addition scenario is provided in the following paragraphs.

This particular study involved handsheets prepared from an acid furnish (pH 4.8). The filler portion of the furnish was prepared from 80% clay (Huber Hi-White) and 20% $TiO_2$ (SCM Glidden Zopague RG). Filler levels in the final furnish were varied at either 10% or 30% of furnish solids. Since the consistency of the final blended furnish was constant at 0.5%, the fiber fraction provided the balance of the furnish solids as the filler level was varied. The fiber segment was comprised of 50% bleached Kraft hardwood and 50% bleached Kraft softwood As indicated in Table 5A, the final additive was papermaker's alum added at 1.0% based on total furnish solids.

A. Gunnarsson Furnish Preparation Method

The Gunnarsson et al. method involved the aqueous dispersion of a dry mixture of cationic starch and xanthan gum in a ratio of 100:0.75, the ratio employed in Example 1 of the Gunnarsson application. The starch utilized was Staley Stalok 600 as described in Example 1 of this work. The xanthan gum used was Kelco Kelzan S. Since the Gunnarsson method required that the starch-xanthan blend be added to a separate filler slurry before mixing with the fiber, the test furnish was prepared in two parts as individual filler and fiber slurries. The starch-xanthan blend (100:0.75) was added to the filler at levels such that the starch content would be either 30 lb/T or 50 lb/T based on total furnish solids (fiber and filler). These two levels were utilized throughout the study. The starch levels were selected in part based on the range indicated by the Gunnarsson application indicating that the dry weight of starch and xanthan should be 2–20% of the dry weight of the filler and most preferably in an amount of 10%. After the proper starch xanthan gum dosage was added to the 25% solids filler slurry, the combination was mixed for 20 seconds at moderate shear on a magnetic stir plate. Aluminum sulfate was then added to the filler dispersion at a level corresponding to 3.0% $Al_2O_3$ on weight of the starch to form the gel structure. This addition level was selected based on the application's claim 2 in which the aluminum sulfate is added in amounts of 0.5–10% calculated as $Al_2O_3$ on weight of the starch added.

The final compound was allowed to mix for 20 seconds on a magnetic stir plate at moderate shear prior to mixing with the cellulose fiber. The gel structure was then blended with the fiber slurry using an impeller-type mixer set at 1200 rpm for 20 seconds. Upon completion of the mixing step, alum was added at 1.0% based on total furnish solids. After an additional 20 seconds of mixing at 1200 rpm, the final stock blend was added to the sheet mold to form the sheet. This entire process was repeated in the preparation of each handsheet simulating the Gunnarsson application method.

B. New Method of Furnish Preparation

The handsheets produced via the Sunden method were compared to the sheets prepared by the new method of application of both the starch and xanthan gum. This approach involved the separate addition of starch and xanthan to the fiber slurry at starch dosage levels corresponding to 30 lb/T and 50 lb/T based on total furnish solids (fiber and filler). The xanthan gum wa added at a level equivalent to 30% of the starch dosage. The same starch and xanthan types utilized in the Gunnarsson method were used in this method.

Starch was added first to the fiber slurry and mixed for 20 seconds at 1200 rpm before the xanthan gum aliquot was added under shear. After an additional 20 seconds of agitation at 1200 rpm, the appropriate quantity of filler slurry was blended with the treated fiber for 20 seconds followed by the addition of 1% alum and 20 seconds of mixing of the final furnish (1200 rpm). The final fiber:filler ratio and total furnish solids were equivalent to those utilized in the preparation of the Gunnarsson method handsheets. As with the Gunnarsson method, the entire furnish-blending process was repeated for each handsheet prepared.

C. Furnish Preparation for Blank Condition (Starch-Only)

Furnish preparation of the blank condition (starch-only) handsheets involved the same blending procedure described for the new method of starch and xanthan application with the important exception being that xanthan gum was not added. In other words, the fiber segment of the furnish was treated with starch (only) prior to the addition of filler and alum.

D. Handsheet Preparation and Testing

Figure 1B:
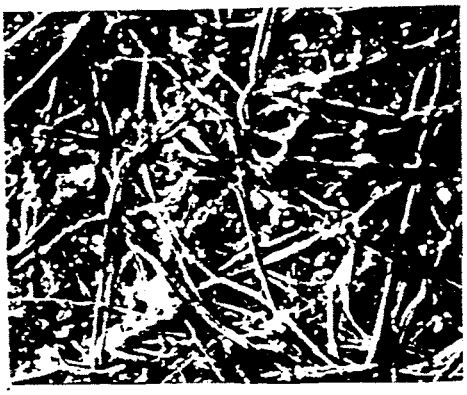
Figure 1C:
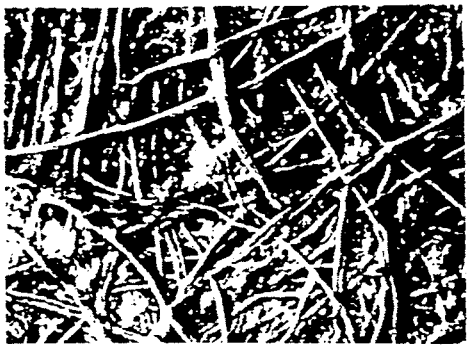
Figure 1D:
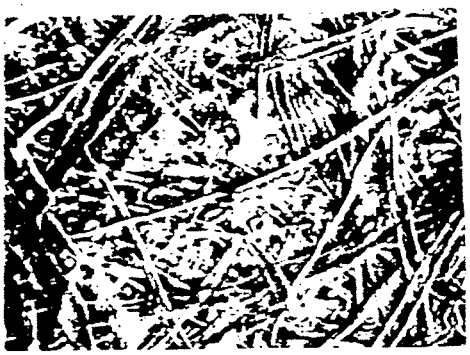
Figure 1E:
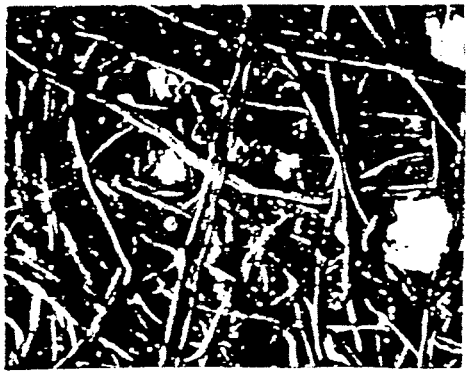
Figure 1F:
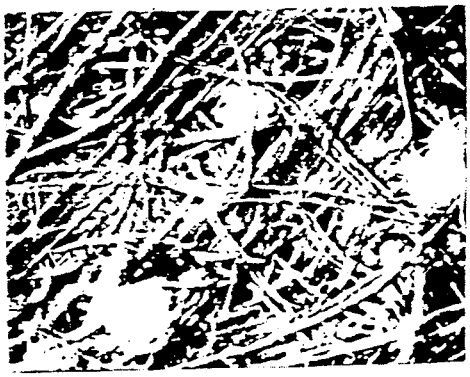
Figure 2A:
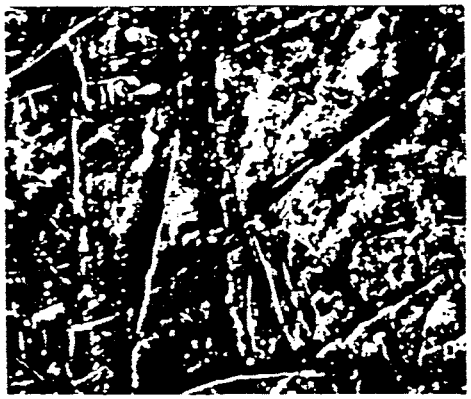
Figure 2B:
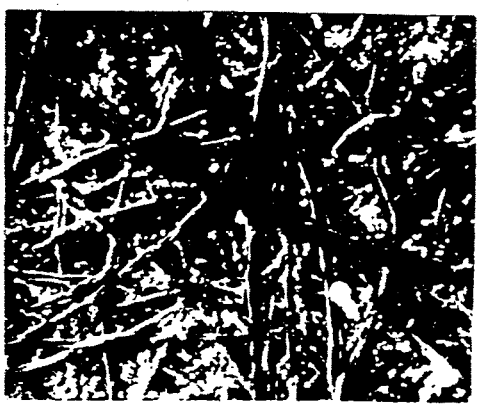
Figure 2C:
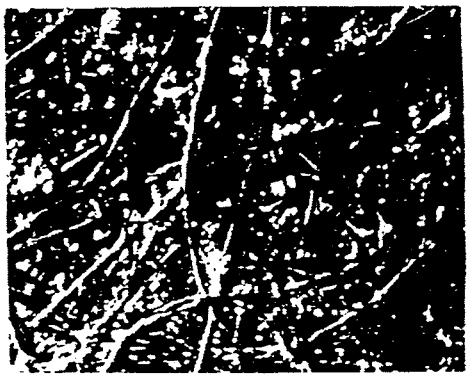
Figure 2D:
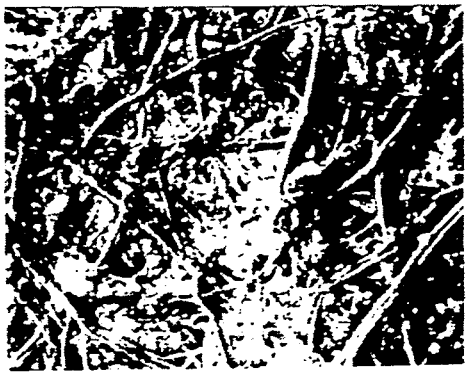
Figure 2E:
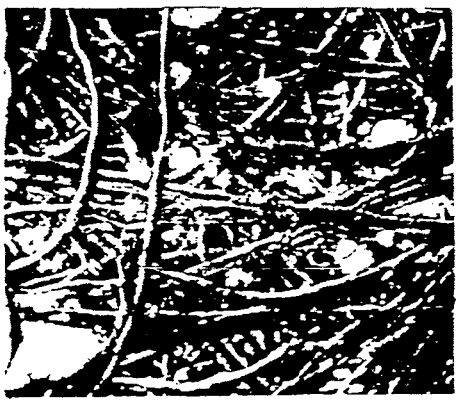
Figure 2F:
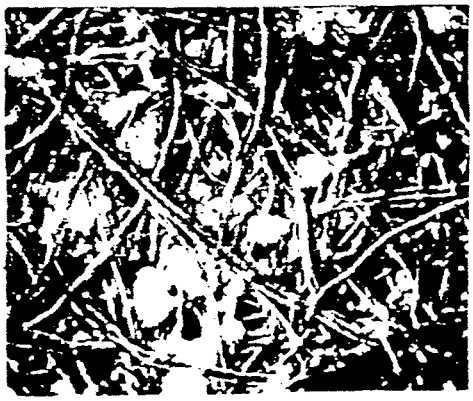

Handsheets for each condition were prepared, cut, and conditioned in the same manner described in Example 2B. Each handsheet was weighed and subsequently evaluated for opacity, brightness, and Mullen Burst. The remaining portion of each handsheet was then ashed in a muffle furnace at 925° C. to determine percent sheet ash. Prior to the ashing step several handsheets were photographed by both a 35 mm camera and a scanning electron microscope (SEM) to provide important information regarding sheet formation and filler distribution. The SEM photos (FIGS. 1A-1F and 2A-2F) are Robinson backscatter images at 90× magnification. The same exact handsheets were placed on a light box and illuminated for photographs taken at a fixed distance with a 35 mm Minolta camera and no magnification. Obviously, the magnified SEM photos provide insight into the distribution of filler in the handsheets while the 35 mm shots describe the sheet formation as observed by the naked eye.

Results of the handsheet evaluation are summarized in Table 5B. The Gunnarsson method and the new method each demonstrated increases in Mullen Burst over the blank (starch-only) case at each experimental condition. However, handsheets prepared via the Gunnarsson method exhibited significantly larger increases over the blank than the new method at the high furnish ash level (30% ash). This result is explained in the following paragraphs.

Burst increases associated with the new method were linked directly to higher starch adsorption in the handsheets. This conclusion was made based on the fact that at each experimental condition the new method handsheets provided burst increases over each blank case while maintaining approximately equivalent opacity and brightness levels. In addition, the SEM photographs of the new method and corresponding blank conditions both demonstrate even filler distribution across fiber surfaces. Thus, since the new method demonstrated consistently higher Mullen Burst over the blank condition while simultaneously maintaining sheet optical properties, filler distribution, and sheet formation, the increased burst strength had to result from enhanced starch adsorption.

On the other hand, the increases in burst strength provided by the Gunnarsson method could not be linked solely to the higher retention of starch in the handsheets. In fact, the substantial improvement in burst by the Gunnarsson process over the new method at the 30% ash level was a direct result of the poor filler distribution in the sheets. For example, the direct reaction of the cationic starch-xanthan gum complex with the filler slurry via the Gunnarsson method resulted in coagulated filler particles which were subsequently retained in localized areas in the handsheets (FIGS. 1A-1F and 2A-2F). The retention of filler as coagulated particles allowed less interruption of the fiber-fiber bonding process than when the filler was evenly distributed across the fiber surfaces in discrete particle form. In other words, the retention of filler in localized areas allowed more intimate fiber-fiber contact (bonding), and consequently led to higher burst values. Aside from the poor filler distribution exhibited by the Gunnarsson method in the SEM photos, the effects of the coagulated filler were also reflected in reduced opacity and brightness data and relatively poor sheet formation. In addition, the starch distribution test indicated that the Gunnarsson method handsheets had poor starch distribution unlike the even distribution found in the blank and new method sheets.

Thus, when all sheet properties are considered, the new method provides a superior program for overall sheet quality. The Gunnarsson method, however, provides increased strength at increased sheet ash content but all at the expense of the sheet optical properties. The adverse effects of the Gunnarsson method on filler distribution, formation, and sheet optical properties were more significant at the higher furnish ash content (30%).

TABLE 5A

SUMMARY OF CHEMICAL ADDITION SEQUENCE/FURNISH PREPARATION METHODS FOR HANDSHEET STUDY COMPARING GUNNARSSON METHOD TO NEW METHOD

| GUNNARSSON ET AL, METHOD (Swedish Applic. #8205592-2) | NEW METHOD | BLANK (STARCH-ONLY) |
|---|---|---|
| Cationic Starch/Xanthan Mixture (0.75% Xanthan based on Starch) | Cationic Starch | Cationic Starch |
| ↓ | ↓ | ↓ |
| Filler Slurry (80% Clay/20% $TiO_2$) | Fiber Slurry (50% Bl SW/50% Bl HW) | Fiber Slurry (50% Bl SW/50% Bl HW) |
| ↓ | ↓ | ↓ |
| Aluminum Sulfate (3% $Al_2O_3$ based on starch) | Xanthan gum (30% Xanthan based on starch) | Filler Slurry (80% Clay/20% $TiO_2$) |
| ↓ | ↓ | ↓ |
| Fiber Slurry (50% Bl SW/50% Bl HW) | Filler Slurry (80% Clay/20% $TiO_2$) | Papermaker's Alum |
| ↓ | ↓ | ↓ |
| Papermaker's Alum | Papermaker's Alum | Form Sheet |
| ↓ | ↓ | |
| Form Sheet | Form Sheet | |

TABLE 5B

HANDSHEET TEST RESULTS

| Addition Method (See Table 5A) | Starch Dosage (Furnish Basis) (lb/T) | Furnish Ash Level (%) | Avg. Sheet Wt./Area ($\mu/m^2$) | Avg. Sheet Ash (%) | Avg Opacity | Avg Bright-ness | Avg Mullen ($g/cm^2$) | Starch Distrib. |
|---|---|---|---|---|---|---|---|---|
| Blank | 30 | 10 | 87.62 | 8.35 | 85.8 | 79.2 | 3630.8 | even color |
| Gunnarsson | 30 | 10 | 86.98 | 8.14 | 81.9 | 77.4 | 3896.6 | small spots |
| New | 30 | 10 | 86.67 | 8.16 | 84.8 | 78.6 | 3863.5 | even color |
| Blank | 50 | 10 | 87.30 | 7.87 | 84.9 | 78.8 | 4037.2 | even color |
| Gunnarsson | 50 | 10 | 86.03 | 8.24 | 81.9 | 77.4 | 4070.2 | small spots |
| New | 50 | 10 | 87.62 | 7.89 | 83.2 | 77.9 | 4289.6 | even color |
| Blank | 30 | 30 | 81.29 | 23.08 | 92.0 | 80.7 | 1894.8 | even color |
| Gunnarsson | 30 | 30 | 82.87 | 24.79 | 87.3 | 77.9 | 2465.1 | small spots |
| New | 30 | 30 | 83.19 | 24.24 | 91.6 | 80.2 | 2036.2 | even color |
| Blank | 50 | 30 | 80.66 | 22.98 | 91.0 | 80.2 | 2216.2 | even color |
| Gunnarsson | 50 | 30 | 83.51 | 24.22 | 87.1 | 77.4 | 2624.0 | small spots |
| New | 50 | 30 | 83.51 | 24.19 | 90.7 | 79.2 | 2446.1 | even color |

While this invention has been described with respect to particular embodiments, therefore, it is apparent that numerous other forms and modifications of this invention will be obvious to those skilled in the art. The appended claims and this invention generally should be construed to cover all such obvious forms and modifications which are within the true spirit and scope of the present invention.

We claim:

1. In the process of making paper by forming a paper furnish comprised of cellulosic fibers or cellulosic fibers and mineral filler material suspended in water, depositing the furnish on a papermaking wire, and forming a sheet out of the solid components of the furnish while carried on the wire, the improvement wherein there is mixed into the furnish, prior to its being deposited on the wire:

1) about 0.50 to 5 percent of cationic starch based on the dry weight to the total solids is the furnish, followed by;

2) about 5 to 60 percent based on the weight of the cationic starch, of a naturally anionic polysaccharide gum having acid functional groups; followed by 3) a polymeric fine solids retention aid added in an effective amount to retain fine solids.

2. The process of claim 1 wherein the cellulosic fiber is comprised of 100% virgin chemical pulp, combinations of virgin chemical pulp and mechanical pulp, combinations of virgin chemical pulp and recycled secondary fiber pulp, or 100% recycled secondary fiber pulp.

3. The process of claim 1 wherein the paper furnish is mixed with cationic starch followed by the naturally anionic polysaccharide gum prior to its combination with mineral filler.

4. The process of claim 3 wherein the degree of substitution on the cationic starch is in the range of about 0.01 to 0.10 cationic substituents per anhydroglucose unit in the starch.

5. The process of claim 3 wherein the cationic starch is added to the furnish in the form of an aqueous dispersion containing about 0.10 to 10 percent cationic starch, based on the weight of the dispersion.

6. The process of claim 3 wherein the pH of the furnish when it is deposited on the papermaking wire is in the range of about 3 to 9.

7. The process of claim 3 wherein the cationic starch is derived from one or more of the starch sources consisting of potato, corn, tapioca, rice or wheat.

8. The process of claim 7 wherein the cationic substituents of the starch utilized are selected from the group consisting of tertiary and quaternary amine groups.

9. The process of claim 8 wherein the cationic starch is amphoteric in nature while maintaining a net cationic functionality.

10. The process of claim 3 wherein the polysaccharide anionic gum effective for the purpose is selected from the group of xanthan gum, gum arabic, karaya, gum ghatti, pectin, tragacanth, or algin.

11. The process of claim 10 wherein the acid functional groups of the natural polysaccharide gums utilized consist of pyruvic, galacturonic, or glucuronic acids.

12. The process of claim 11 wherein the average molecular weight of the xanthan or other anionic polysaccharide gum is in the range of 100,000 to 3 million.

13. The process of claim 3 wherein the concentration of the aqueous solution of the anionic polysaccharide gum utilized is about 0.1% to 5.0%.

14. The process of claim 1 wherein the polymeric retention aid is selected from the group consisting of acrylamide monomer, a combination of acrylamide and acrylic acid monomers, and a combination of acrylamide monomer and any cationic moiety.

15. The process of claim 14 wherein the charge density of the polymeric retention aid is within the range of 1% to 40% expressed as the mole percent of cationic or anionic charged moiety.

16. The process of claim 15 wherein the average molecular weight of the polymeric retention aid ranges from 1 million to 18 million.

17. A paper produced in accordance with claim 1.

18. In the process of making paper by forming a paper furnish comprised of cellulosic fibers or cellulosic fibers and mineral filler material suspended in water, depositing the furnish on a papermaking wire, and forming a sheet out of the solid components of the furnish while carried on the wire, the improvement wherein there is mixed into the furnish, prior to its being deposited on the wire:

1) about 0.50 to 5 percent of cationic starch based on the dry weight of the total solids in the furnish, followed by;

2) about 5 to 60 percent, based on the weight of the cationic starch, of a xanthan gum having acid functional groups; followed by 3) a polymeric fine solids retention aid added in an effective amount to retain fine solids.

19. The process of claim 18 wherein the cellulosic fiber is comprised of 100% virgin chemical pulp, combinations of virgin chemical pulp and mechanical pulp, combinations of virgin chemical pulp and recycled secondary fiber pulp, or 100% recycled secondary fiber pulp.

20. The process of claim 18 wherein the paper furnish is mixed with cationic starch followed by xanthan gum prior to its combination with mineral filler.

21. The process of claim 18 wherein the degree of substitution on the cationic starch is in the range of about 0.01 to 0.10 cationic substituents per anhydroglucose unit in the starch.

22. The process of claim 18 wherein the cationic starch is added to the furnish in the form of an aqueous dispersion containing about 0.10 to 10 percent cationic starch, based on the weight of the dispersion.

23. The process of claim 18 wherein the pH of the furnish when it is deposited on the papermaking wire is in the range of about 3 to 9.

24. The process of claim 18 wherein the cationic starch is derived from one or more of the starch sources consisting of potato, corn, tapioca, rice or wheat.

25. The process of claim 24 wherein the cationic substituents of the starch utilized are selected from the group consisting of tertiary and quaternary amine groups.

26. The process of claim 25 wherein the cationic starch may be amphoteric in nature while maintaining a net cationic functionality.

27. The process of claim 18 wherein the acid functional groups of the natural polysaccharide gums utilized are selected from the group consisting of pyruvic, galacturonic, and glucuronic acids.

28. The process of claim 18 wherein the average molecular weight of the xanthan or other anionic polysaccharide gum are in the range of 100,000 to 3 million.

29. The process of claim 18 wherein the concentration of the aqueous solution of the xanthan gum or other anionic polysaccharide gum utilized is about 0.1% to 5.0%.

30. The process of claim 18 wherein the polymeric retention aid is selected from the group consisting of acrylamide monomer, a combination of acrylamide and acrylic acid monomers, and a combination of acrylamide monomer and any cationic moiety.

31. The process of claim 30 wherein the charge density of the polymeric retention aid is within the range of 1% to 40% expressed as the mole percent of cationic or anionic charged moiety.

32. The process of claim 31 wherein the average molecular weight of the polymeric retention aid ranges from 1 million to 18 million.

33. A paper produced in accordance with claim 18.

* * * * *